US009861172B1

(12) United States Patent
Wang

(10) Patent No.: US 9,861,172 B1
(45) Date of Patent: Jan. 9, 2018

(54) LUGGAGE HANDLE ASSEMBLY WITH TWO PUSH BUTTONS

(71) Applicant: Shuen Hsuan Wang, Miaoli (TW)

(72) Inventor: Shuen Hsuan Wang, Miaoli (TW)

( * ) Notice: Subject to any disclaimer, the term of this patent is extended or adjusted under 35 U.S.C. 154(b) by 0 days.

(21) Appl. No.: 15/485,265

(22) Filed: Apr. 12, 2017

(51) Int. Cl.
*A45C 13/26* (2006.01)
*B62B 5/06* (2006.01)

(52) U.S. Cl.
CPC ..... *A45C 13/26* (2013.01); *B62B 5/067* (2013.01); *Y10T 16/4554* (2015.01)

(58) Field of Classification Search
CPC . A45C 13/26; A45C 2013/267; A45C 13/262; B62B 5/067; Y10T 16/4554; Y10T 16/473; Y10T 16/451
USPC ..... 16/405, 429, 113.1; 190/115, 18 A; 280/655.1, 47.371, 47.315
See application file for complete search history.

(56) References Cited

U.S. PATENT DOCUMENTS 5,522,615 A * 6/1996 Kazmark, Jr. ..... A45C 13/262 190/18 A
5,806,143 A * 9/1998 Tsai ..... A45C 13/262 16/405
5,956,807 A * 9/1999 Kuo ..... A45C 13/262 16/113.1
6,128,806 A * 10/2000 Shou-Mao ..... A45C 13/262 16/113.1
6,170,122 B1 * 1/2001 Kuo ..... A45C 13/262 16/405
6,305,514 B1 * 10/2001 Lin ..... A45C 13/262 190/115
6,484,362 B1 * 11/2002 Kuo ..... A45C 13/262 16/113.1
6,609,271 B2 * 8/2003 Kuo ..... A45C 13/262 16/113.1
2004/0181905 A1 * 9/2004 Chang ..... A45C 13/262 16/110.1
2005/0183914 A1 * 8/2005 Lin ..... A45C 13/262 190/115
2006/0225981 A1 * 10/2006 Lin ..... A45C 13/262 190/115

* cited by examiner

*Primary Examiner* — William Miller
(74) *Attorney, Agent, or Firm* — Alan D. Kamrath; Kamrath IP Lawfirm, P.A.

(57) ABSTRACT

A handle assembly for a luggage includes a grip unit, a button unit and a crank unit. The button unit includes a left push and a right push button. The crank unit includes a left crank having a first end provided with a left resting section abutting the left push button and a second end provided with a left ratchet section, a right crank having a first end provided with a right resting section abutting the right push button and a second end provided with a right ratchet section engaging the left ratchet section. Thus, the button unit includes two push buttons mounted on two opposite ends of the grip unit, so that the button unit will not be touched or pressed by the user, thereby preventing the handle assembly from being unlocked inadvertently.

10 Claims, 8 Drawing Sheets

LUGGAGE HANDLE ASSEMBLY WITH TWO PUSH BUTTONS

BACKGROUND OF THE INVENTION

1. Field of the Invention

The present invention relates to a handle assembly and, more particularly, to a handle assembly for a luggage.

2. Description of the Related Art

A conventional retractable handle assembly 10 for a luggage in accordance with the prior art shown in FIGS. 1 and 2 comprises a handle 11 having two ends each provided with an outer pipe 14, an intermediate pipe 13 movably mounted in the outer pipe 14 and having a plurality of locking holes 131, an inner pipe 12 movably mounted in the intermediate pipe 13, and a link 121 pressed by the handle 11 and extending into the inner pipe 12. A pressing plate 17 is movably mounted in the handle 11 and has two ends abutting the upper end of the link 121. The pressing plate 17 is provided with a push button 16 protruding from the handle 11. Each of the inner pipe 12 and the intermediate pipe 13 has a bottom end provided with a locking device 15 which includes a fixing seat 151, a locking pin 153 movably mounted in the fixing seat 151 and having a first end detachably locked in one of the locking holes 131 of the intermediate pipe 13, an elastic member 154 mounted in the fixing seat 151 and biased between the fixing seat 151 and a second end of the locking pin 153 to push the locking pin 153 toward the respective locking hole 131 of the intermediate pipe 13, and a V-shaped control member 152 pivotally mounted in the fixing seat 151 and having a first end rested on a lower end of the link 121 and a second end locked on the second end of the locking pin 153. In operation, when the push button 16 is pressed, the pressing plate 17 is moved downward to move the link 121 downward which presses and pivots the control member 152 which moves the locking pin 153 to detach from one of the locking holes 131 so as to unlock the locking device 15, so that the handle assembly 10 is released and can be pulled outward or retracted inward. However, the push button 16 is located at the middle position of the handle 11 so that the push button 16 is easily touched or pressed by the user's hand. Thus, when the push button 16 is touched or pressed unintentionally, the handle assembly 10 is released and disposed at the retracted state, thereby hindering movement of the luggage, and thereby causing inconvenience to the user. In addition, when the luggage is moved during the unlocked state, the locking device 15 easily rubs the inner wall of the intermediate pipe 13, thereby wearing the intermediate pipe 13.

BRIEF SUMMARY OF THE INVENTION

The primary objective of the present invention is to provide a luggage handle assembly with two push buttons located at two ends thereof In accordance with the present invention, there is provided a handle assembly comprising a grip unit, a button unit mounted on the grip unit, and a crank unit mounted in the grip unit. The grip unit is provided with a first limit groove and a second limit groove located at two sides thereof. The grip unit is further provided with a first mounting recess located under the first limit groove and a second mounting recess located under the second limit groove. The button unit includes a left push button limited in the first limit groove of the grip unit and provided with a left pressing section, a first compression spring mounted on a lower end of the left push button, a right push button limited in the second limit groove of the grip unit and provided with a right pressing section, and a second compression spring mounted on a lower end of the right push button. The crank unit includes a left crank having a first end provided with a left resting section abutting the left pressing section of the left push button and a second end provided with a left ratchet section, a right crank having a first end provided with a right resting section abutting the right pressing section of the right push button and a second end provided with a right ratchet section, a left linking rod having an upper end resting on a lower end of the left resting section, and a right linking rod having an upper end resting on a lower end of the right resting section.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
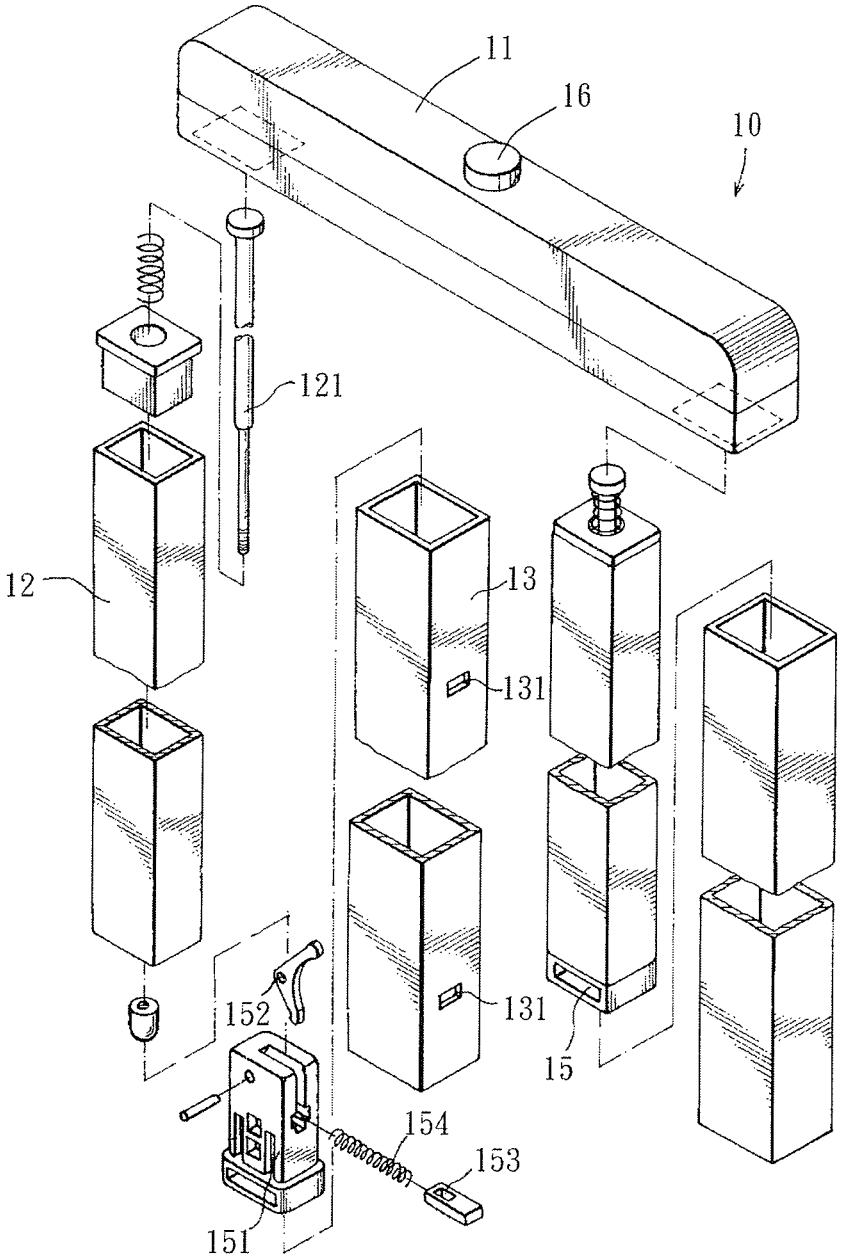
FIG. 1 PRIOR ART
FIG. 1 is an exploded perspective view of a conventional handle assembly for a luggage in accordance with the prior art.
Figure 2:
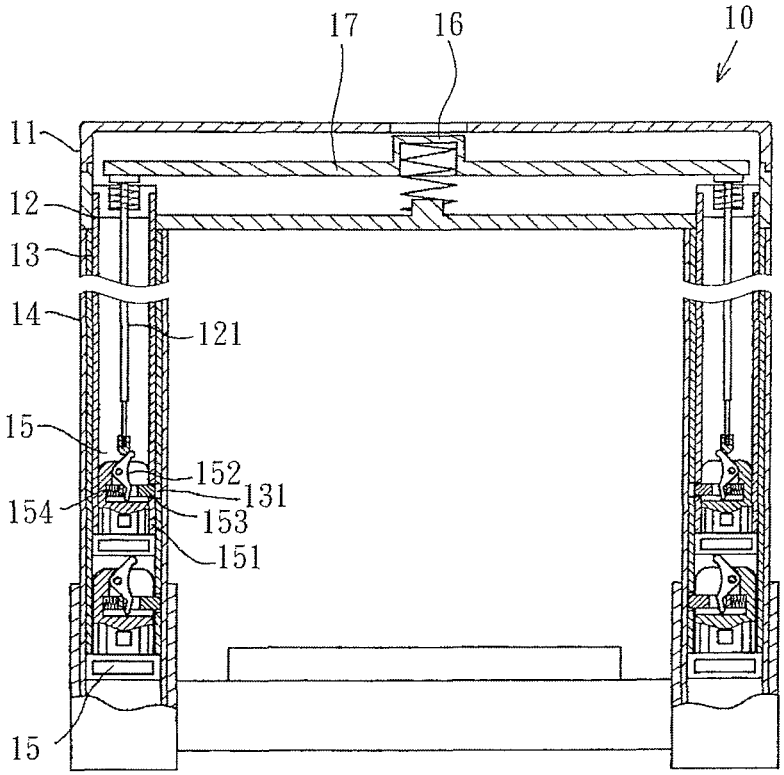
FIG. 2 PRIOR ART
FIG. 2 is a cross-sectional assembly view of the conventional handle assembly for a luggage as shown in FIG. 1.
Figure 3:
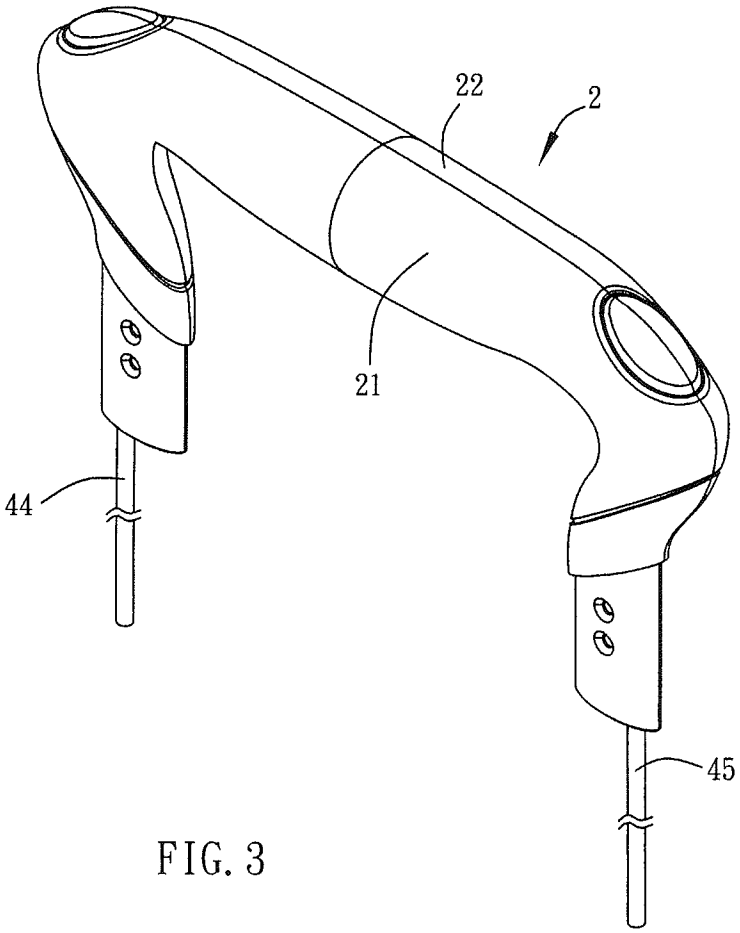
FIG. 3 is a perspective view of a handle assembly for a luggage in accordance with the preferred embodiment of the present invention.
Figure 4:
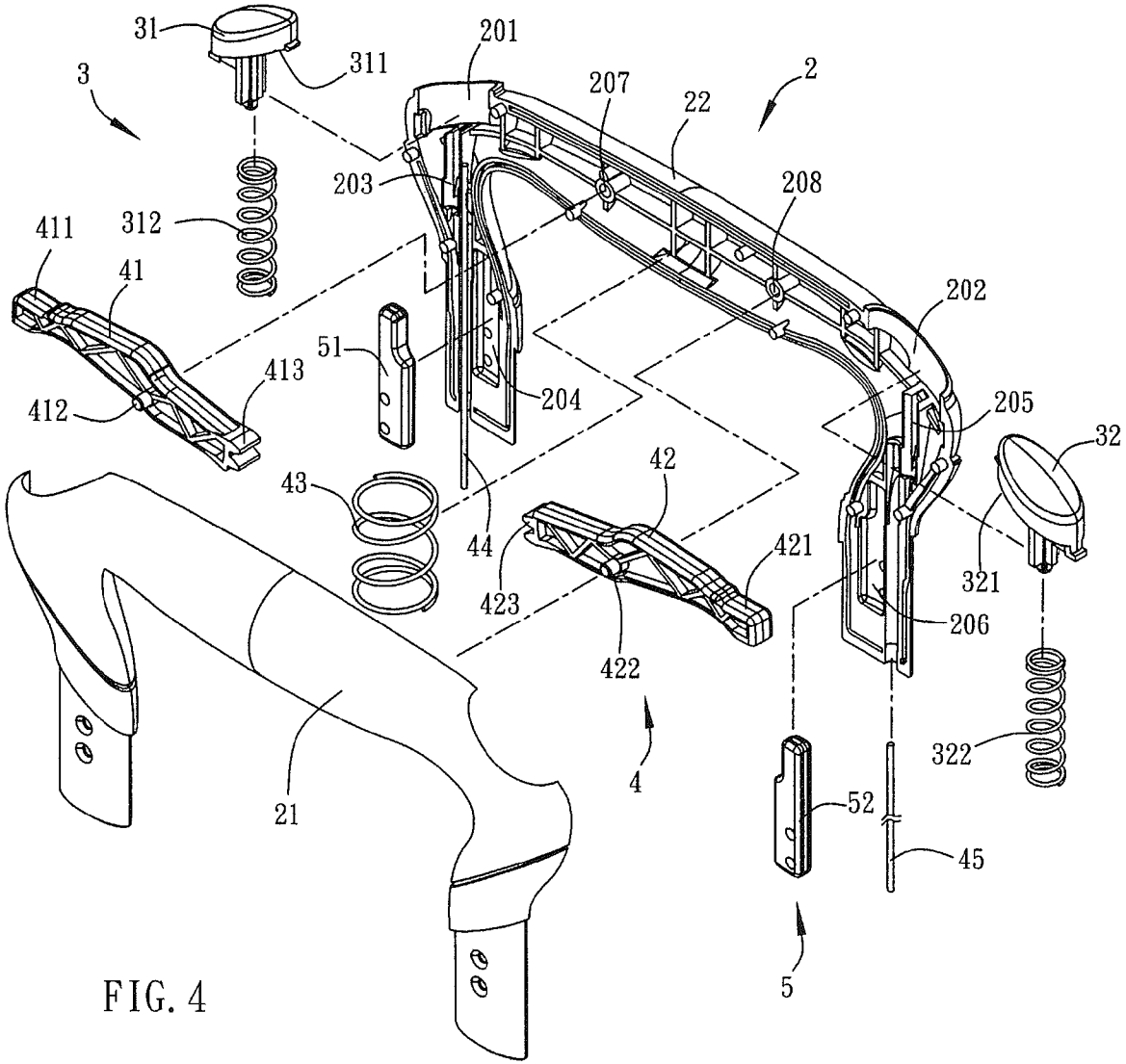
FIG. 4 is an exploded perspective view of the handle assembly for a luggage as shown in FIG. 3.
Figure 5:
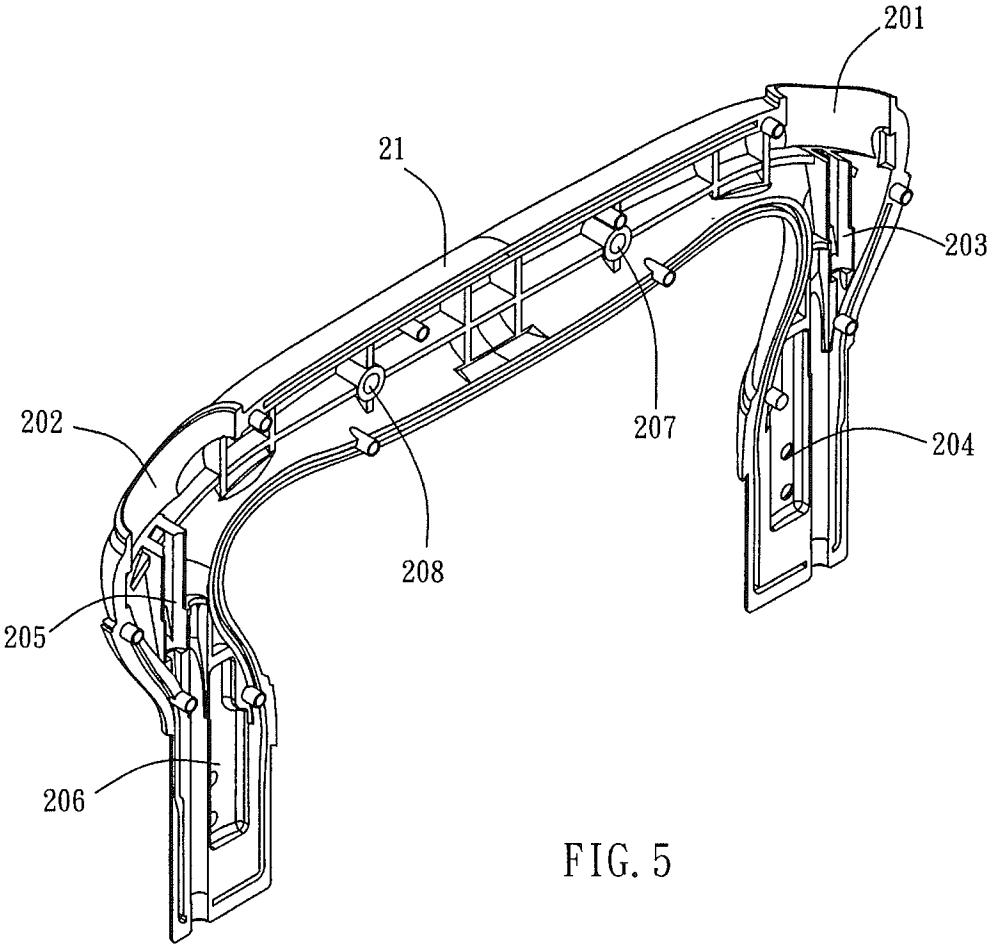
FIG. 5 is a perspective view of a front grip of the handle assembly for a luggage as shown in FIG. 3.
Figure 6:
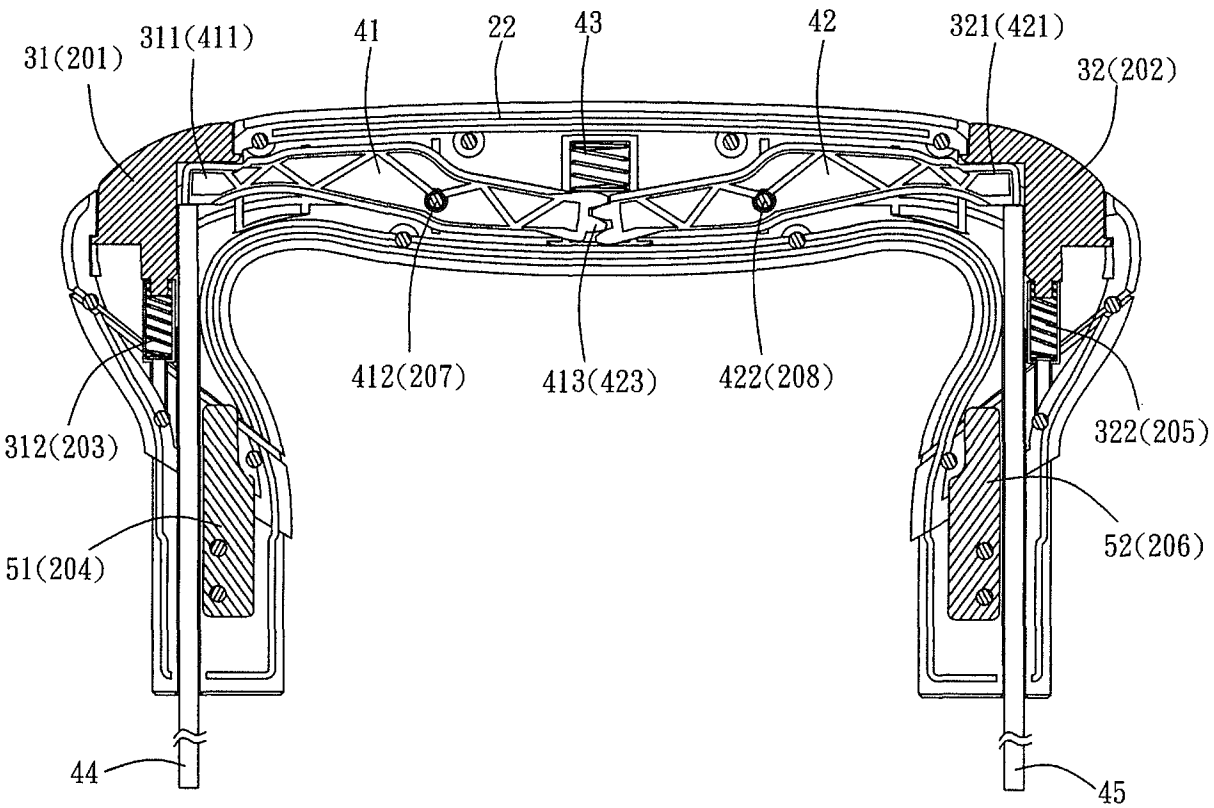
FIG. 6 is a cross-sectional view of the handle assembly for a luggage as shown in FIG. 3.

Referring to the drawings and initially to FIGS. 3-6, a handle assembly for a luggage in accordance with the preferred embodiment of the present invention comprises a grip unit 2, a button unit 3 mounted on the grip unit 2, and a crank unit 4 mounted in the grip unit 2.

The grip unit 2 is provided with a first limit groove 201 and a second limit groove 202 located at two sides thereof. The grip unit 2 is further provided with a first mounting recess 203 located under the first limit groove 201 and a second mounting recess 205 located under the second limit groove 202.

The button unit 3 includes a left push button 31 limited in the first limit groove 201 of the grip unit 2 and provided with a left pressing section 311, a first compression spring 312 mounted on a lower end of the left push button 31, a right push button 32 limited in the second limit groove 202 of the grip unit 2 and provided with a right pressing section 321, and a second compression spring 322 mounted on a lower end of the right push button 32.

The crank unit 4 includes a left crank 41 having a first end provided with a left resting section 411 abutting the left pressing section 311 of the left push button 31 and a second end provided with a left ratchet section 413, a right crank 42 having a first end provided with a right resting section 421 abutting the right pressing section 321 of the right push button 32 and a second end provided with a right ratchet section 423, a left linking rod 44 having an upper end resting on a lower end of the left resting section 411, and a right linking rod 45 having an upper end resting on a lower end of the right resting section 421.

In the preferred embodiment of the present invention, the grip unit 2 includes a front grip 21 and a rear grip 22 juxtaposed to each other and combined together.

In the preferred embodiment of the present invention, the grip unit 2 is further provided with a first mounting channel 204 located under the first limit groove 201 and a second mounting channel 206 located under the second limit groove 202, and the handle assembly further comprises a reinforcing unit 5 mounted in the grip unit 2 and including a left reinforcing member 51 mounted in the first mounting channel 204 of the grip unit 2 and a right reinforcing member 52 mounted in the second mounting channel 206 of the grip unit 2. The reinforcing unit 5 is used to reinforce the structural strength of a connection of the grip unit 2 and an outer pipe.

In the preferred embodiment of the present invention, the first compression spring 312 of the button unit 3 is limited in the first mounting recess 203 of the grip unit 2, and the second compression spring 322 of the button unit 3 is limited in the second mounting recess 205 of the grip unit 2.

In the preferred embodiment of the present invention, the grip unit 2 is further provided with a first mounting hole 207 and a second mounting hole 208, the left crank 41 of the crank unit 4 is provided with a left shaft 412 pivotally mounted in the first mounting hole 207 of the grip unit 2, and the right crank 42 of the crank unit 4 is provided with a right shaft 422 pivotally mounted in the second mounting hole 208 of the grip unit 2.

In the preferred embodiment of the present invention, the left ratchet section 413 of the left crank 41 engages the right ratchet section 423 of the right crank 42.

In the preferred embodiment of the present invention, the crank unit 4 further includes a third compression spring 43 located above and pressing the left ratchet section 413 of the left crank 41 and the right ratchet section 423 of the right crank 42.

In assembly, the left push button 31 is mounted in the first limit groove 201 of the grip unit 2, and the right push button 32 is mounted in the second limit groove 202 of the grip unit 2. Then, the first compression spring 312 is mounted on the lower end of the left push button 31 and is limited in the first mounting recess 203 of the grip unit 2, while the second compression spring 322 is mounted on the lower end of the right push button 32 and is limited in the second mounting recess 205 of the grip unit 2. Then, the left shaft 412 of the left crank 41 is pivotally mounted in the first mounting hole 207 of the grip unit 2, and the right shaft 422 of the right crank 42 is pivotally mounted in the second mounting hole 208 of the grip unit 2, with the left ratchet section 413 of the left crank 41 engaging the right ratchet section 423 of the right crank 42, and with the third compression spring 43 pressing the left ratchet section 413 of the left crank 41 and the right ratchet section 423 of the right crank 42. At this time, the left resting section 411 of the left crank 41 abuts the left pressing section 311 of the left push button 31, and the right resting section 421 of the right crank 42 abuts the right pressing section 321 of the right push button 32. Then, the left reinforcing member 51 is mounted in the first mounting channel 204 of the grip unit 2, and the right reinforcing member 52 is mounted in the second mounting channel 206 of the grip unit 2. Finally, the front grip 21 and the rear grip 22 are juxtaposed to each other and combined together to assemble the handle assembly for a luggage.

Figure 7:
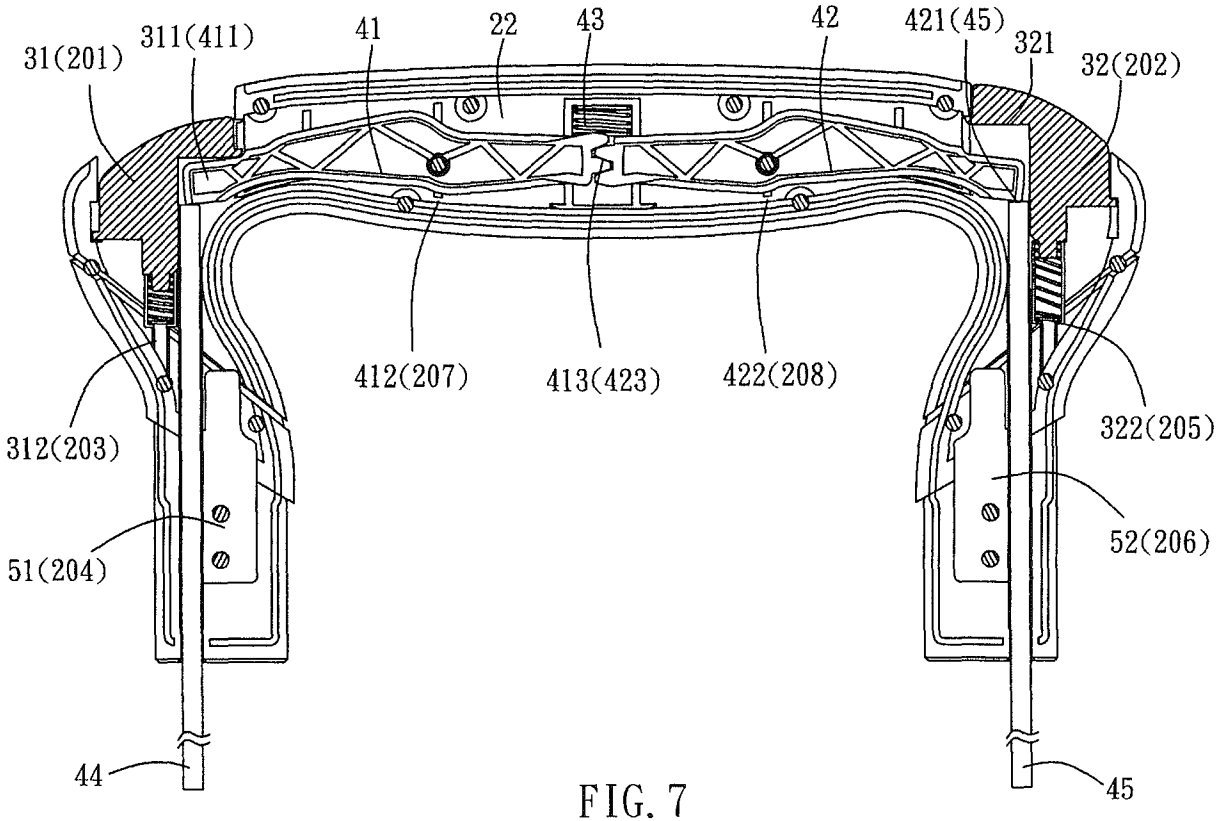
FIG. 7 is a schematic operational view of the handle assembly for a luggage as shown in FIG. 6.

In operation, referring to FIG. 7 with reference to FIGS. 3-6, when the handle assembly is used by a left-hand user, the left push button 31 is pressed by the user's left thumb to move the left pressing section 311 which presses the left resting section 411 which presses the left linking rod 44 which links and operates a locking device (not shown). The operation of the left linking rod 44 and the locking device is conventional and will not be further described in detail. At the same time, the left crank 41 is pivoted about the left shaft 412 so that when the left resting section 411 is moved downward, the left ratchet section 413 is moved upward, and the right ratchet section 423 engaging the left ratchet section 413 is also moved upward. When the right ratchet section 423 is moved upward, the right crank 42 is pivoted about the right shaft 422, so that the right resting section 421 is moved downward, to press the right linking rod 45 which links and operates the locking device. In such a manner, the user only needs to press the left push button 31 to unlock the locking device so as to release the handle assembly, so that the handle assembly can be pulled outward or retract inward. Thus, the left push button 31 is located at one side of the grip unit 2, so that the left push button 31 will not be touched or pressed inadvertently by the user. After the force applied on the left push button 31 disappears, the left push button 31 is pushed by the restoring force of the first compression spring 312 to return to the original position, while the left ratchet section 413 of the left crank 41 and the right ratchet section 423 of the right crank 42 are pushed by the restoring force of the third compression spring 43 to return to the original position.

Figure 8:
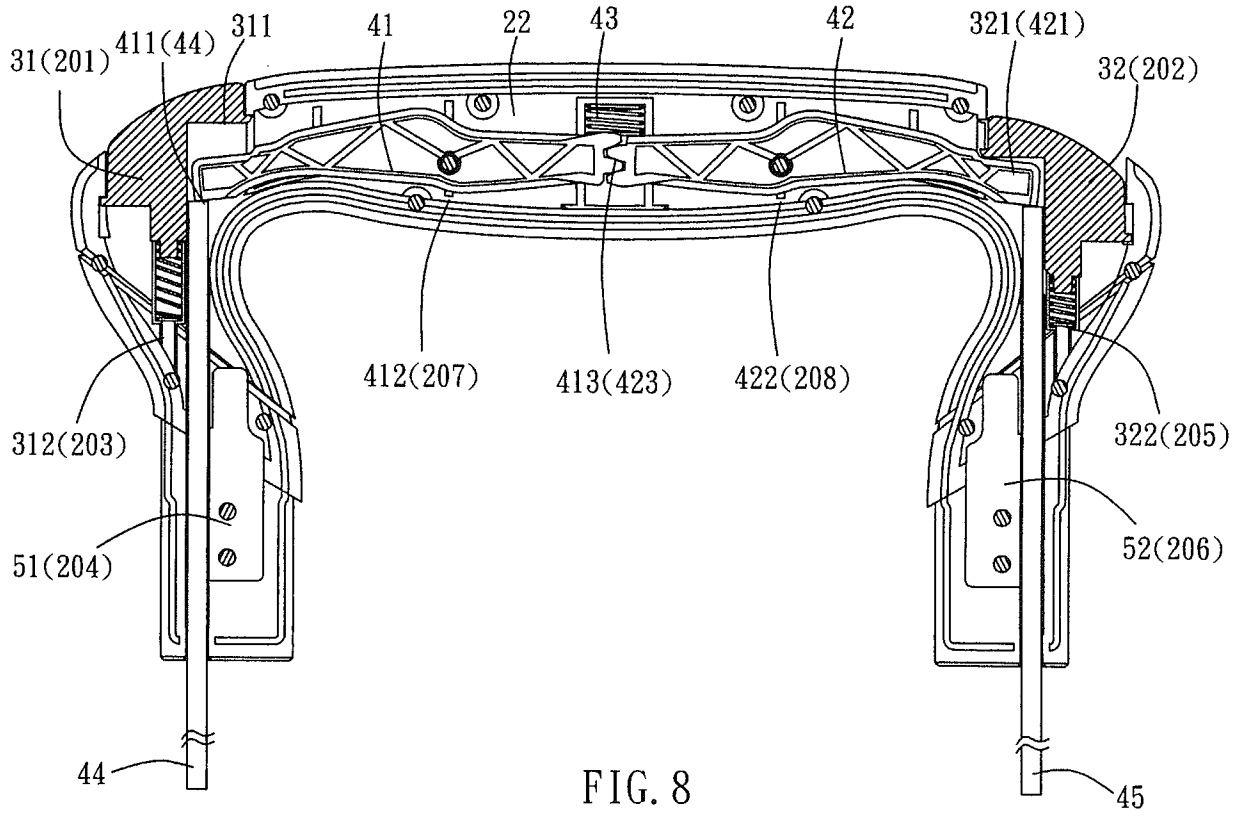
FIG. 8 is a schematic operational view of the handle assembly for a luggage as shown in FIG. 6.

On the contrary, referring to FIG. 8 with reference to FIGS. 3-6, when the handle assembly is used by a right-hand user, the right push button 32 is pressed by the user's right thumb to move the right pressing section 321 which presses the right resting section 421 which presses the right linking rod 45 which links and operates the locking device. At the same time, the right crank 42 is pivoted about the right shaft 422 so that when the right resting section 421 is moved downward, the right ratchet section 423 is moved upward, and the left ratchet section 413 engaging the right ratchet section 423 is also moved upward. When the left ratchet section 413 is moved upward, the left crank 41 is pivoted about the left shaft 412 so that the left resting section 411 is moved downward, to press the left linking rod 44 which links and operates the locking device. In such a manner, the user only needs to press the right push button 32 to unlock the locking device so as to release the handle assembly, so that the handle assembly can be pulled outward or retract inward. Thus, the right push button 32 is located at one side of the grip unit 2, so that the right push button 32 will not be touched or pressed inadvertently by the user. After the force applied on the right push button 32 disappears, the right push button 32 is pushed by the restoring force of the second compression spring 322 to return to the original position, while the left ratchet section 413 of the left crank 41 and the right ratchet section 423 of the right crank 42 are pushed by the restoring force of the third compression spring 43 to return to the original position.

Accordingly, the button unit 3 includes two push buttons 31 and 32 mounted on two opposite ends of the grip unit 2, so that the button unit 3 will not be touched or pressed freely by the user, thereby preventing the handle assembly from being unlocked inadvertently. In addition, the button unit 3 is available for right-hand and left-hand users, thereby enhancing the versatility of the handle assembly. Further, the user only needs to press the left push button 31 or the right push button 32 to unlock the locking device so as to release the handle assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A handle assembly comprising:

a grip unit;

a button unit mounted on the grip unit; and a crank unit mounted in the grip unit;

wherein:

the grip unit is provided with a first limit groove and a second limit groove located at two sides thereof;

the grip unit is further provided with a first mounting recess located under the first limit groove and a second mounting recess located under the second limit groove;

the button unit includes:

a left push button limited in the first limit groove of the grip unit and provided with a left pressing section;

a first compression spring mounted on a lower end of the left push button;

a right push button limited in the second limit groove of the grip unit and provided with a right pressing section; and a second compression spring mounted on a lower end of the right push button;

the crank unit includes:

a left crank having a first end provided with a left resting section abutting the left pressing section of the left push button and a second end provided with a left ratchet section;

a right crank having a first end provided with a right resting section abutting the right pressing section of the right push button and a second end provided with a right ratchet section;

a left linking rod having an upper end resting on a lower end of the left resting section; and a right linking rod having an upper end resting on a lower end of the right resting section.

2. The handle assembly of claim 1, wherein the grip unit includes a front grip and a rear grip juxtaposed to each other and combined together.

3. The handle assembly of claim 1, wherein the grip unit is further provided with a first mounting channel located under the first limit groove, and the handle assembly further comprises a left reinforcing member mounted in the first mounting channel of the grip unit.

4. The handle assembly of claim 3, wherein the grip unit is further provided with a second mounting channel located under the second limit groove, and the handle assembly further comprises a right reinforcing member mounted in the second mounting channel of the grip unit.

5. The handle assembly of claim 1, wherein the first compression spring of the button unit is limited in the first mounting recess of the grip unit.

6. The handle assembly of claim 1, wherein the second compression spring of the button unit is limited in the second mounting recess of the grip unit.

7. The handle assembly of claim 1, wherein the grip unit is further provided with a first mounting hole, and the left crank of the crank unit is provided with a left shaft pivotally mounted in the first mounting hole of the grip unit.

8. The handle assembly of claim 7, wherein the grip unit is further provided with a second mounting hole, and the right crank of the crank unit is provided with a right shaft pivotally mounted in the second mounting hole of the grip unit.

9. The handle assembly of claim 1, wherein the left ratchet section of the left crank engages the right ratchet section of the right crank.

10. The handle assembly of claim 1, wherein the crank unit further includes a third compression spring located above and pressing the left ratchet section of the left crank and the right ratchet section of the right crank.

* * * * *